United States Patent [19]

Ferro et al.

[11] Patent Number: 4,539,803

[45] Date of Patent: Sep. 10, 1985

[54] DEVICE TO PIECE-UP YARN AND DOFF YARN PACKAGES ON OPEN-END SPINNING MACHINES

[75] Inventors: Francesco Ferro, Pordenone; Giosuè Franci, Azzano Decimo, both of Italy

[73] Assignee: Officine Savio S.p.A., Pordenone, Italy

[21] Appl. No.: 515,633

[22] Filed: Jul. 20, 1983

[30] Foreign Application Priority Data

Oct. 12, 1982 [IT] Italy ..... 83460 A/82

[51] Int. Cl.[3] ..... D01H 15/00; D01H 9/10

[52] U.S. Cl. ..... 57/263; 57/266; 57/268; 57/270; 242/35.5 A

[58] Field of Search ..... 57/263, 261, 266, 268, 57/270, 271, 274; 242/35.5 A

[56] References Cited

U.S. PATENT DOCUMENTS

| | | | |
|---|---|---|---|
| 4,120,140 | 10/1978 | Raasch et al. | 57/263 |
| 4,125,990 | 11/1978 | Stahlecker et al. | 242/35.5 A |
| 4,139,162 | 2/1979 | Stahlecker et al. | 57/263 X |
| 4,178,748 | 12/1979 | Stahlecker et al. | 57/263 |
| 4,178,749 | 12/1979 | Stahlecker et al. | 57/263 |

FOREIGN PATENT DOCUMENTS 1528642 10/1978 United Kingdom .

*Primary Examiner*—Donald Watkins

*Attorney, Agent, or Firm*—Fitzpatrick, Cella, Harper & Scinto

[57] ABSTRACT

An improved device to piece-up yarn and doff yarn packages on open-end spinning machines. The device comprises a carriage (12) equipped with specific means for the tasks of piecing-up yarn and doffing yarn packages, said carriage being supported cantilever-wise by an arm (13) secured to a trolley (15) able to run on lengthwise guides (17), said carriage (12) being equipped with an arm (20) to hold tubes which cooperates with a store (18) of tubes.

6 Claims, 7 Drawing Figures

DEVICE TO PIECE-UP YARN AND DOFF YARN PACKAGES ON OPEN-END SPINNING MACHINES

This invention concerns an improved device to piece-up yarn and doff yarn packages on open-end spinning machines, said device consisting advantageously of a carriage which is equipped with means able to perform the sequence of operations envisaged for piecing-up the yarn and doffing the yarn package.

This invention proposes a set of improvements to said type of device, which is already known in itself.

In the known lay-outs said type of carriage moves on guides which have a U-shaped path or path with a closed ring that encircles the sides of the spinning machine, whereby a lower supporting guide is included which entails considerable problems in view of the presence of the slivers, the need to have access to the spinning zone and to open each spinning unit and also the need to have access to the drive headstocks.

Moreover, in the known lay-outs said travelling carriage bears with it a necessarily limited number of tubes and has to go back periodically to the loading station with resultant losses of output owing to its travelling time.

Furthermore, so as to feed the means with which said carriage is equipped, the known art envisages either a complex centralized lay-out or else sockets for the various sources of feed for said carriage on each spinning unit, with resultant high costs, great complexity and large overall sizes.

This invention proposes to overcome said problems and shortcomings by providing lengthwise guides for the carriage in the upper part of the machine and by arranging for the carriage to be supported at one of its ends by an arm thus eliminating the lower supporting guide.

Furthermore, if a fixed feed for the individual units and therefore not a centralized feed is employed, this invention proposes to equip the movable carriage with a manifold having several plugs which are spaced apart from each other by a given pitch and which can be connected to the fixed sockets of the spinning units, so as to reduce the number of sockets for the various sources of feed cooperating with the carriage.

With this lay-out the number of fixed sockets on the individual units can be reduced in a ratio inversely proportional to the number of plugs embodied on the manifold.

Indeed, the same fixed socket can serve several neighbouring units as it can be connected in succession to the various plugs of the movable manifold when the carriage is moved so as to act on the neighbouring units.

The invention also proposes two improvements for the specific means able to perform the operations of piecing-up the yarn and doffing the yarn packages.

In particular, the invention proposes to embody a head for gripping tubes, said head being obtained on the group that aspirates the yarn and consisting of three idler rolls which allow the tube to be rotated when the latter is alongside the winding roller, so as to enable the yarn to be attached and drawn by the tube already rotating.

This lay-out also makes possible a secure gripping of the yarn, which can be held between the tube and the tailstock of the package-bearing arm and not just attached by adhering to the surface of the tube, as happens in the known art.

According to the invention said head for gripping tubes cooperates advantageously with a store of tubes envisaged on each spinning station and holding two or more tubes, said store being fed by hand or automatically.

The invention also proposes to obtain, by means of a mechanical arm during the phase of piecing-up the yarn, a reserve of yarn to be introduced into the small pipe for the piecing-up.

It is known that an accurately determined length of yarn has to be introduced into the small pipe of the spinning unit so that said yarn reaches the throat of the rotor exactly if it is wished to perform the piecing-up of the yarn correctly.

Systems are known which consist of pairs of rollers driven by small motors, the number of revolutions or the working time being measured. These systems are costly and not reliable.

To carry out said function our invention envisages a mechanical arm having a path which may perhaps be regulated and having a pneumatic drive.

This arm has two positions so that, cooperating with the phase of unwinding the yarn package, it can determine the length of yarn needed and can then deliver it, during the return of the arm itself, to the spinning unit, which brings back said yarn owing to the effect of the negative pressure in the spinning chamber.

According to one aspect of the invention the employment of an auxiliary yarn package is envisaged for piecing-up the yarn. Said auxiliary yarn package is located on the carriage and can consist of any yarn.

The end of the yarn is taken from the auxiliary yarn package and inserted into the small pipe for the piecing-up.

The pieced-up yarn coming from the auxiliary yarn package is taken on delivery by the doffing arm. The completed yarn package is discharged.

The tract of auxiliary yarn employed for the piecing-up and also the flaw resulting from said piecing-up are eliminated.

The new tube is inserted and the yarn without the flaw due to the piecing-up is transferred thereto.

The use of the auxiliary yarn package enables the doffing cycle itself to be employed also for the operations of changing a batch and of the first start-up of the machine.

This invention is therefore embodied with an improved device to piece-up yarn and doff yarn packages on open-end spinning machines, characterized by comprising a carriage (12) equipped with specific means for the tasks of piecing-up yarn and doffing yarn packages and supported cantilever-wise by an arm (13) secured to a trolley (15) able to run on lengthwise guides (17), said carriage (12) being equipped with an arm (20) to hold tubes which cooperates with a store (18) of tubes.

We shall give hereinafter, as a non-restrictive example, the description of a preferred embodiment of the invention with the help of the attached tables, wherein:

FIG. 1 gives a side view of the carriage;

FIGS. 2*a* and 2*b* show the manifold connecting the carriage to the fixed sockets of the spinning units;

In the figures the same parts or parts having the same functions bear the same reference numbers.

Figure 1:
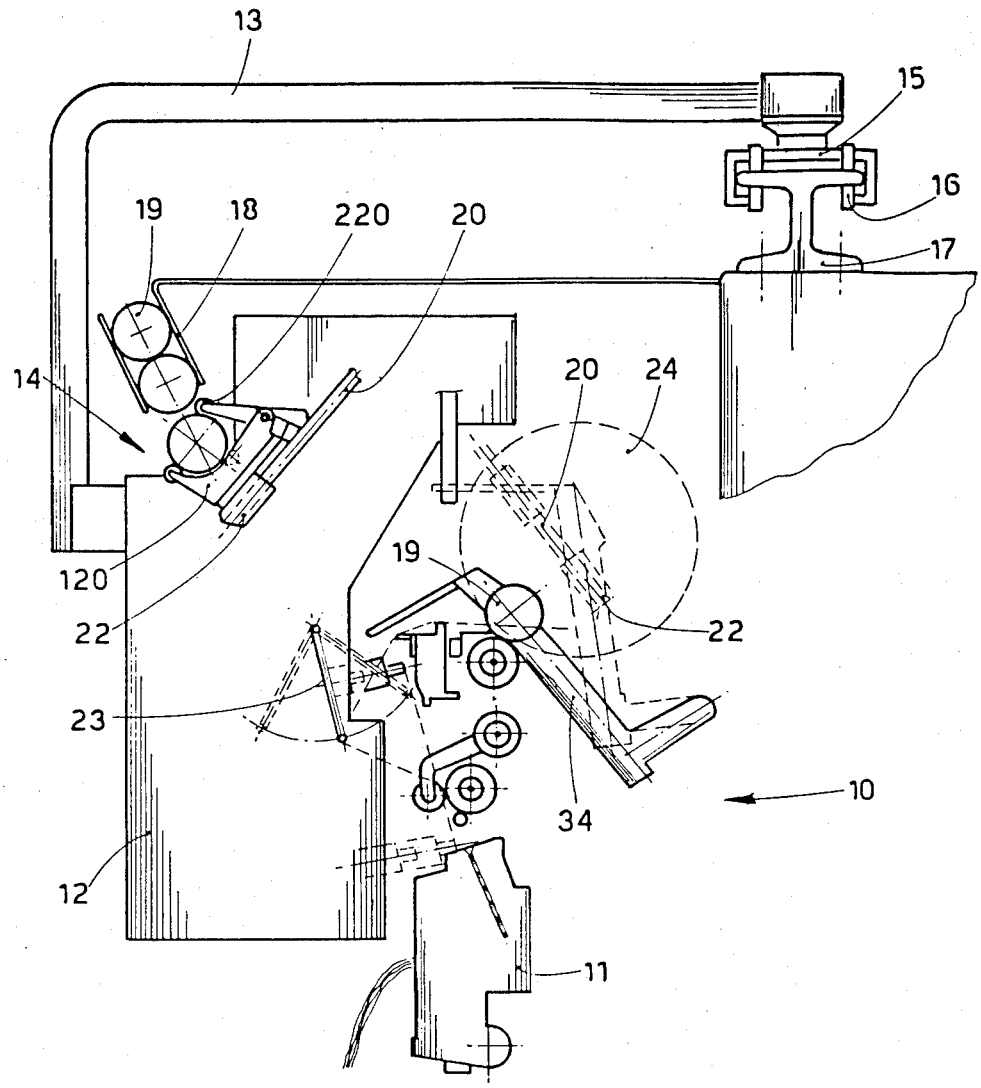

In the figures, 10 is the open-end spinning machine to which the device of our invention is fitted; 11 is a spinning unit with a rotor.

In front of the spinning unit 11 is a carriage 12, which is supported cantilever-wise by an arm 13, which in turn is solidly fixed to a trolley 15.

Said trolley 15 can run, by means of wheel-wise or roller-wise or other movement means 16, along a lengthwise guide 17 formed of a T-shaped or I-shaped section, for example.

According to the invention, there can be one or more guides 17.

Movement of the trolley 15 on the lengthwise guide 17 and therefore of the carriage 12 along the spinning machine 10 is obtained with suitable drive means. Said latter means may consist of a motor fitted to said trolley 15 and driving the wheel-wise or roller-wise movement means 16, or may consist of belts, cables or chains which pull the trolley, or else of toothed wheels and a rack, the type of drive of the trolley 15 not being relevant for the purposes of the invention.

Thus the carriage 12 can move lengthwise along the spinning machine 10 so as to be brought into correspondence with the spinning units 11 to be served.

A tube store 18 is fixed, for instance high up above each spinning station (FIG. 1), on the spinning machine so as to correspond with each spinning unit 11.

Said store 18 can hold at least two tubes 19 and is made in such a way as to enable the tubes 19 to be loaded into its upper end and to be withdrawn from its lower end.

The carriage 12 comprises a cutaway portion 14 corresponding with the position of the tube store 18, so that the tube stores 18 (one for each spinning station) do not interfere with the movement of the carriage 12 along the spinning machine 10.

A rotatable arm 20 equipped with a head 120 able to grip tubes 19 is pivoted on the carriage 12. The head 120 which grips tubes consists of a gripper with three idler rolls 220, which enable tube 19 to rotate when the rotation of said arm 20 has brought the tube 19 alongside the winding roller 21.

Said arm 20 can be telescopic so as to permit the positioning of the head 120 during the two phases of gripping the tube and of bringing the tube alongside the winding roller. An aspirating intake 22 is located at the end of said arm 20.

An arm 23 which is pivoted on the carriage 12 and can move between two positions has the task of making ready an adequate length of yarn forming the reserve for the piecing-up while the yarn package 24 is unwinding.

Figure 3:
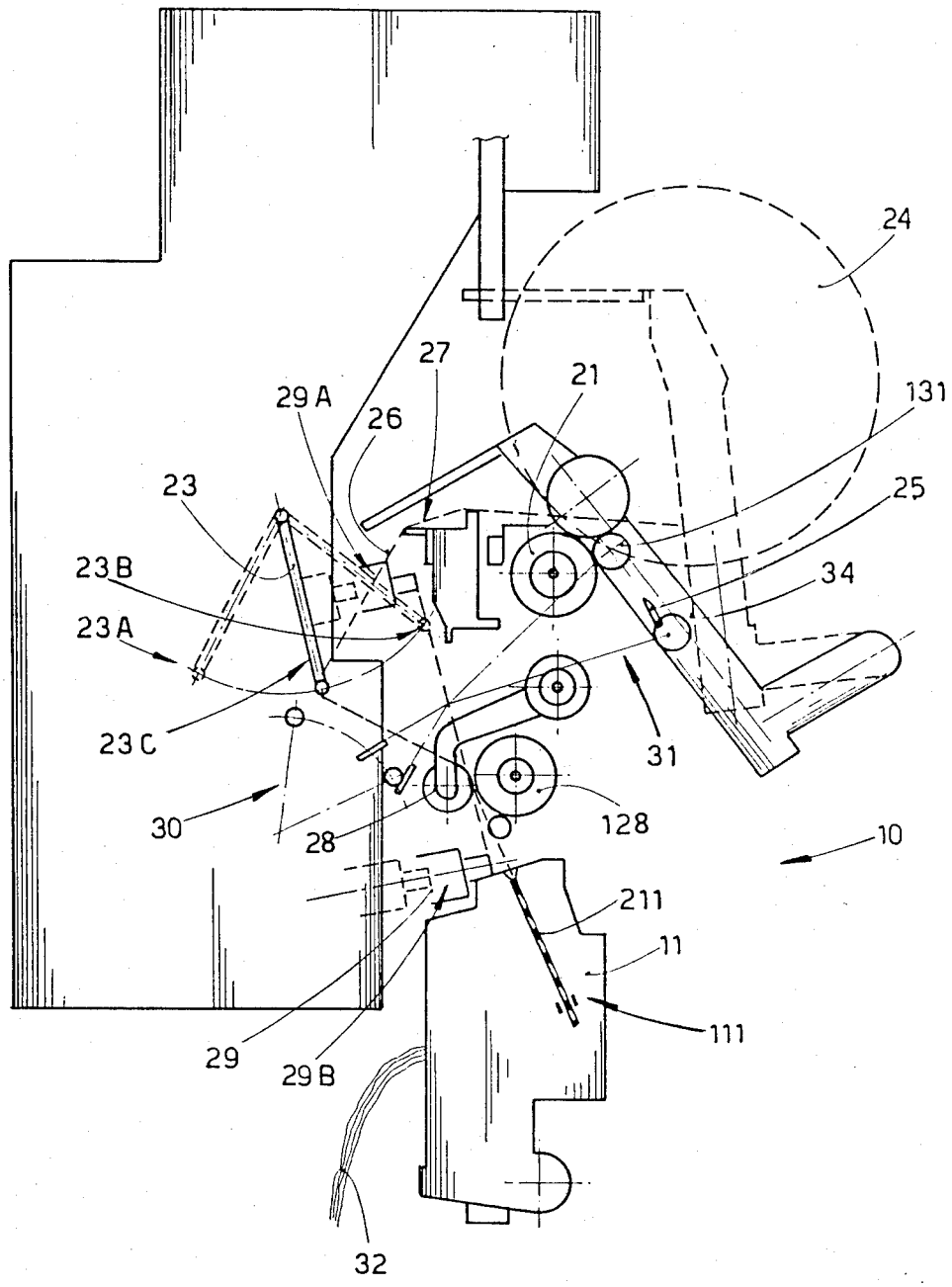
FIGS. 3, 4 and 5 show the methods of working A, B and C (or D) respectively.
Figure 4:
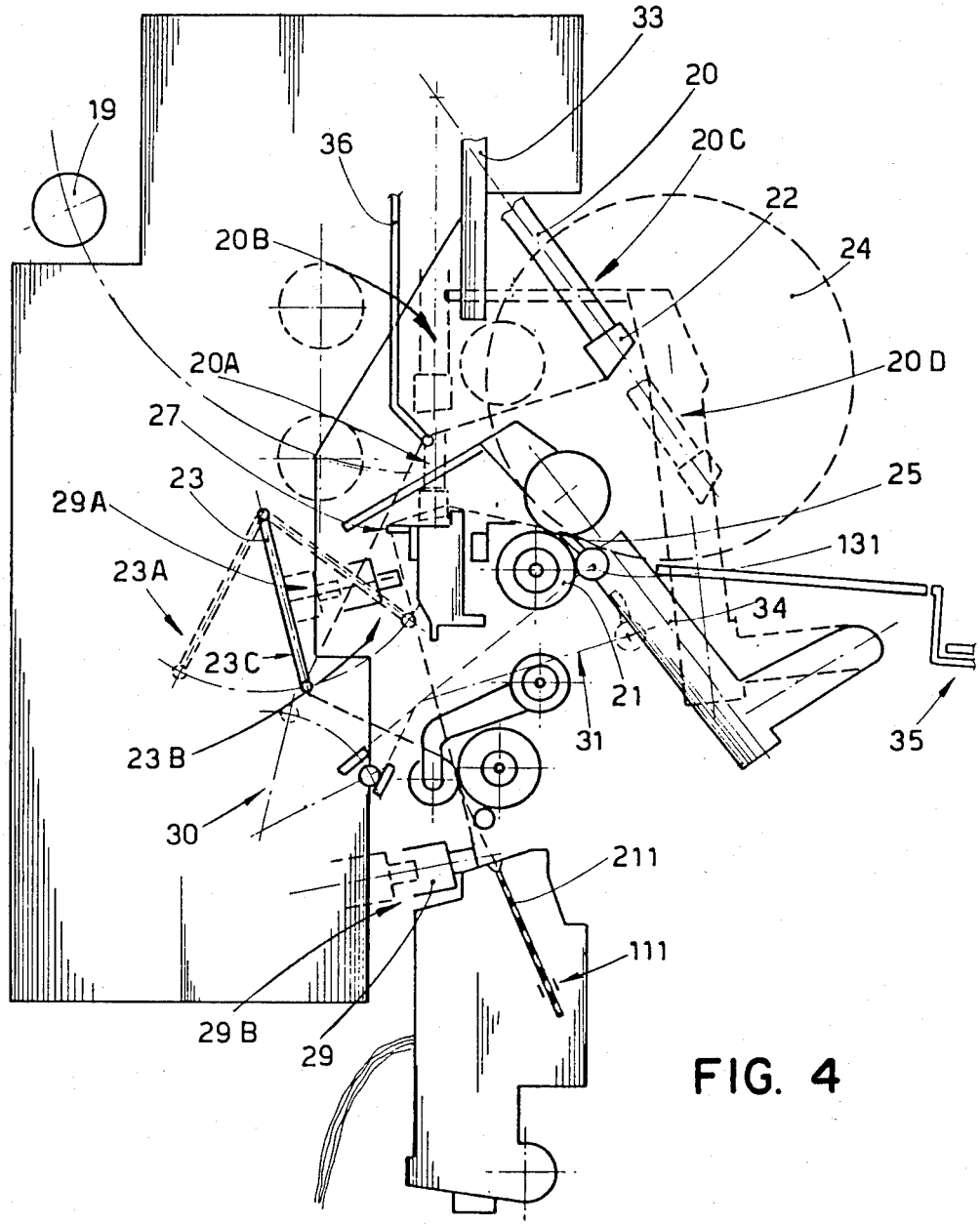
Figure 5:
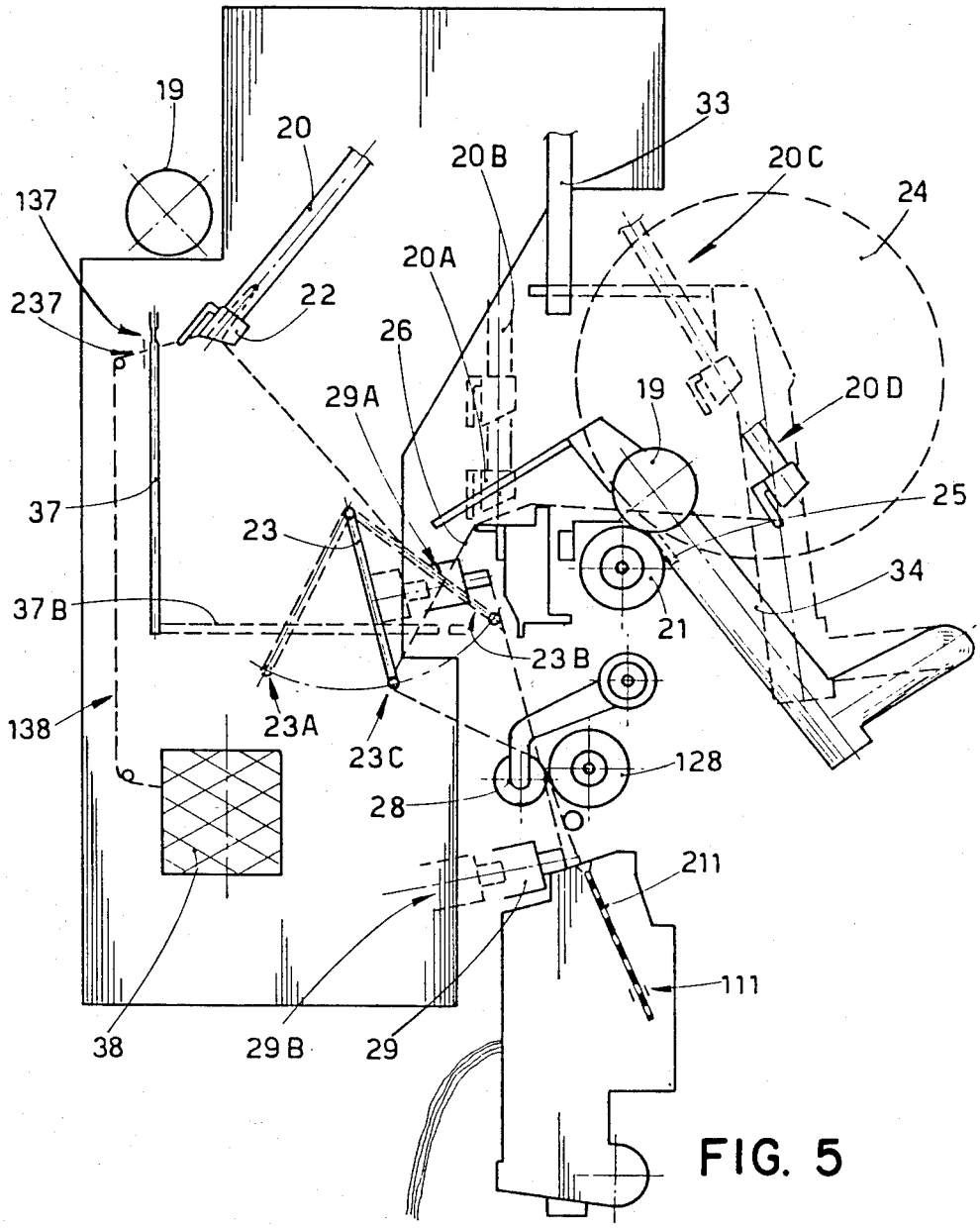

The working of the device is as follows, four working situations being envisaged:

(A) piecing-up of the yarn owing to accidental breakage, the yarn being taken from the yarn package being processed (FIG. 3);

(B) cutting of the yarn when the desired length has been reached, the yarn being taken from the completed package and the package being doffed (FIG. 4);

(C) piecing-up the yarn at the start of processing, an auxiliary yarn package on the carriage being used (FIG. 5)

(D) moreover, the auxiliary package can also be used for the automatic doffing when the desired length has been reached or when the batch is changed.

This is made possible by the fact that the yarn coming from the auxiliary package is eliminated after the piecing-up. In this way the new package being wound does not contain the flaw of the piecing-up. We shall give a summary of said methods of working hereinafter.

(A) Piecing-up the yarn owing to accidental breakage (FIG. 3)

Accidental breakage of yarn in the rotor or small pipe: the sensor 111 loated so as to correspond with the small pipe 211 makes known the lack of yarn 26 and trips the latch 25; the yarn package 24 is raised, the end of the yarn 26 is gripped in the grippers 27 and the extraction roller 28 is raised. Alternatively, the yarn can be taken directly by a movable aspirating intake located on the carriage, said intake also arranging for alignment so as to make possible the successive delivery of yarn to the intake 29.

The feed is halted. Piecing-up takes place as follows:

(a) the aspiration intake 29 aspirates the end of the yarn in the raised position 29A;

(b) the system of levers 30–31 brings the roller 131 alongside the yarn package 24 and winding cylinder 21 and opens the grippers 27 a little; the yarn package 24 unwinds, being set in contrarotation by the roller 131, which in turn is pulled by the winding roller 21. The yarn is taken up by the intake 29. The arm 23 is brought to its advanced position 23B;

(c) a small quantity of sliver 32 is fed;

(d) the spinning unit 11 is opened;

(e) the rotor is cleaned;

(f) the spinning unit 11 is closed;

(g) the intake 29 is brought to its low position 29B; the yarn passes before the arm 23 and between the roller 28 and extraction cylinder 128;

(h) the arm 23 moves away and creates the reserve of yarn at position 23A;

(i) the cutting of the yarn 26 with known means and the untwisting inside the intake 29 take place;

(l) the intake 29 moves away and the end of the yarn 26 is introuced into the small pipe 211;

(m) the arm 23 moves to its intermediate position 23C and a given quantity of yarn 26 is introduced into the small pipe 211 until it is near the sensor 111;

(n) the arm 23 goes back to its position 23B; all the yarn 26 in the reserve is brought back by the rotor;

(o) the sensor 111 senses the yarn 26; the feed starts up, the extraction roller 28 is lowered, the yarn package 24 descends onto the take-up cylinder 21 and the grippers 27 open fully.

If the piecing-up is not successful, the sensor 111 gives a new signal and the starting situation exists once again.

As a variant and so as to optimize better the momentary sequence of the phases of starting-up, feeding and beginning the extraction, it is possible to envisage that the relative commands are given not by the sensor 111 but by a system of timers which can be regulated to suit the kind of yarn and which are located on the carriage.

(B) The yarn is cut and the yarn package is doffed as the length requied has been reached. (FIG. 4)

The length indicator (not shown) halts the feed; the sensor 111 trips the latch 25; the yarn package 24 is raised; the end of the yarn 26 is held in the grippers 27, and the extraction roller 28 is raised.

Piecing-up of the yarn and doffing (a) The aspiration intake 29 aspirates the end of the yarn; the arm 20 moves to position 20A;

(b) the system of levers 30–31 brings the roller 131 alongside the yarn package 24 and the winding cylinder 21 and opens the grippers 27 a little; the yarn package 24 unwinds and the yarn 26 is aspirated by the intake 29; the arm 23 moves to its advanced position 23B;

(c) the aspiration in the arm 20 is started and a portion of the yarn is aspirated by the intake 22;

(d) the system of levers 30–31, and therefore the roller 131, return to their starting position; the piecing-up cycle continues as per points Ac to Am of situation "A".

If the piecing-up is not successful, the yarn 26 is cut in correspondence with the intake 22 and is discharged thereby and the cycle from (a) to (d) is repeated, or else the arm 20 returns to its starting position and there will be a "Start of processing" cycle whenever there is an auxiliary yarn package (see point "c").

If the outcome of the piecing-up is successful, the yarn being produced is temporarily aspirated by the intake 22;

(e) the yarn 26 is cut with known means between the yarn package 24 and intake 22;

(f) the rod 33 opens the arm 34 which bears the yarn package; the yarn package 24 slides onto the conveyor belt 35 which conveys yarn packages;

(g) the arm 20, which bears the tube 19 with itself, is raised and takes the yarn 26 to positions 20B and 20C in succession;

(h) as soon as the arm 20 moves, the lever 36 rotates and takes the yarn 26 to a position suitable for the formation of the coils of reserve yarn on the tube;

(i) the rod 33 takes downwards the arm 34, which stays open;

(l) the arm 20 moves to position 20D; in this way the tube 19, which is held between the rolls 220, begins to rotate, coming into contact with the winding roller 21; the yarn 26 passes between the rotating tube 19 and the arm 24 which bears the yarn package and which is still open;

(m) the rod 33 is disengaged and goes back to its starting position. The arm 34 closes, while the yarn 26 is cut with known means behind the tube 19;

(n) the arm 20 returns and, in its return course, makes the arm 36 rotate backwards, thus permitting the beginning of winding the yarn package.

(C) Piecing-up the yarn with the use of the auxiliary yarn package at the start of processing. (FIG. 5)

(a) As the yarn is absent, the feed is halted; the roller 28 is raised and the latch 25 is forward, the starting situation being the same as before;

(b) the arm 37 equipped with the gripper means 137 or with suitable feed means brings the yarn 138 of the auxiliary yarn package 38 to the intake 29 by means of a clockwise rotation to position 37B, thereby passing below the intake 22, which has its aspiration shut off; the intake 29 in position 29A takes delivery of the yarn 138, and the arm 23 moves to its advanced position 23B;

(c) aspiration in the arm 20 is started and a part of the yarn 138 is aspirated by the intake 22;

(d) the intake 29 is moved to its lower position 29B and thus makes the yarn 138 pass before the arm 23 and behind the small roller 28. The arm 23 is moved to position 23A and thus brings the yarn 138 to form the reserve for the piecing-up;

(e) the arm 37, having released the yarn 138, goes back to its starting position and cuts the yarn 138 with shearing means 237 between the auxiiary yarn package 38 and the intake 22.

The yarn 138 thus becomes contained between the intake 22, the arm 23 forming the reserve, and the intake 29 at its low position 29B and runs between the roller 128 and the small roller 28, which is raised;

(f) the arm 20 is brought to position 20A; the intake 29 frees the yarn 138, which becomes engaged in the small pipe 211; the arm 23 forming the reserve is brought to position 23C and then to position 23B, and the yarn 138 constituting the reserve penetrates into the small pipe 211. The sensor 111 senses the yarn 138 and the spinning process is re-started.

The new yarn 26 pieced-up with the yarn 138 of the auxiliary yarn package comes out from the spinning unit;

(g) the tract of yarn 138–26 comprising the piecing-up flaw is aspirated by the intake 22 of the doffing arm 20;

(h) the yarn 138–26 comprising the piecing-up flaw is cut and discharged through the intake 22;

(i) the arm 20 is brought to positions 20C and 20D; the rod 33 lowers the arm 34 bearing the uyarn package. The yarn 26 thus becomes contained between the tube 19 and tailstock of the arm 34;

(l) the new yarn 26 contained between the tube 19 and winding roller 21 is wound onto the tube 19.

(D) Automatic doffing with employment of the auxiliary yarn package.

The feed is halted as the required length has been reached or because the batch is to be changed, the starting situation being the same as in the earlier cases.

(a) The yarn 26 is cut with known means and the yarn package 24 is discharged;

(b) the cycle goes on as in situation "c" from point (b) to point (l) (FIG. 5).

Figure 2A:
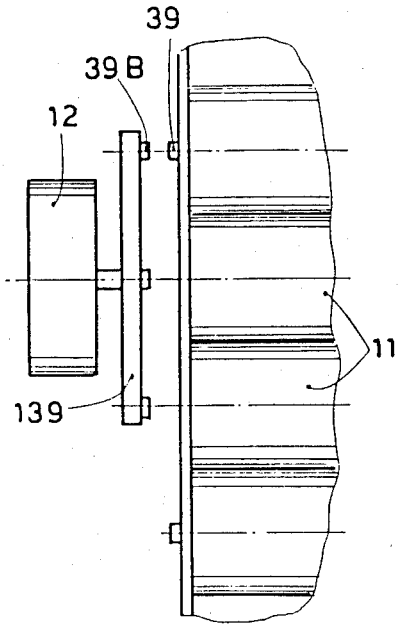
Figure 2B:
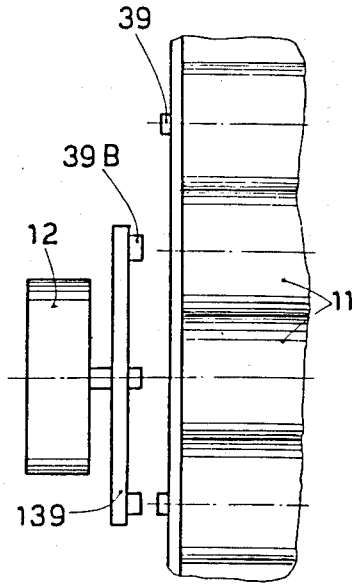

So as to lessen the number of sockets 39 for compessed and/or aspirated air to feed the devices on the carriage 12, the invention visualises the use of a manifold device 139 (FIG. 2).

Said manifold 139 consists of a set of plugs 39B separated by a constant pitch the same as the distance between two neighbouring spinning units 11.

In this way a smaller number of fixed sockets 39 can be envisaged on the spinning machine 10 as compared to a case wherein the carriage 12 is equipped with only one plug 39B.

To be more exact, if "n" is the number of plugs 39B on the manifold, the distance between two fixed sockets 39 will be "n" times the pitch between the plugs 39B rather than being the same as the distance between two neighbouring spinning units 11, as would be the case if there were only one plug 39B on the carriage 12.

Thereby, for each position of the carriage 12 there will always be a socket 39 connected to one of the plugs 39B on the manifold 139, as we have shown diagrammatically in FIGS. *2a* and *2b*.

Figure 6:
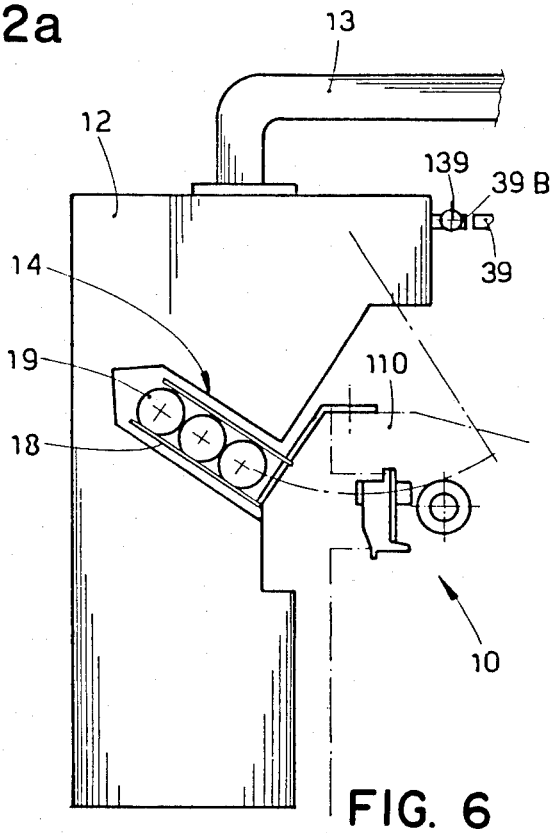
FIG. 6 shows diagrammatically a further lay-out of the tube store.

In another lay-out of the invention (FIG. 6), instead of the tube store 18 being located outside the carriage, it can be located therewithin between the carriage and the spinning machine and be secured, for instance, to the lower part 110 of the spinning machine 10. This enables the overall size, both upwards and sideways, to be reduced since the arm 13 no longer has to pass over the store 18.

A greater rigidity of the whole assembly is thus obtained owing to the smaller length of the arm.

Further variants of the invention are possible for a person skilled in this field without departing thereby from the basic idea of the invention itself.

INDEX

10—open-end spinning machine
11—spinning unit
111—sensor
211—small pipe
12—carriage
13—arm
14—cutaway portion
15—trolley
16—movement means
17—guide
18—tube store
19—tube
20—arm to hold tubes
20A—position of arm to hold tubes
20B—position of arm to hold tubes
20C—position of arm to hold tubes
20D—position of arm to hold tubes
120—head to grip tubes
220—rolls
21—winding roller
22—aspiration intake
23—arm to form reserve of yarn
23A—position of reserve
23B—normal position
23C—intermediate position
24—yarn package
25—latch to raise yarn package
26—yarn
27—gripping point
28—extraction roller
128—extraction cylinder
29—intake
29A—high position of intake
29B—low position of intake
30—lever
31—lever
131—roller
32—sliver
33—rod
34—arm bearing yarn package
35—conveyor belt for yarn packages
36—arm.

We claim:

1. An improved device to piece-up yarn and doff yarn packages on open-end spinning machines, comprising a carriage (12) equipped with specific means for the tasks of piecing-up yarn and doffing yarn packages and supported cantileverwise by an arm (13) secured to a trolley (15) able to run on lengthwise guide means (17), said carriage (12) being equipped with an arm (20) to hold tubes and which cooperates with a tube store (18), the arm (20) being provided with means (120) for gripping tubes from said tube store and transporting same to a position alongside a winding roller, said means for gripping tubes enabling the tubes to be rotated when alongside the winding roller.

2. An improved device to piece-up yarn and doff yarn packages as in claim 1, wherein the store (18) for tubes is solidly fixed to the spinning machine (10), and there is one store (18) for tubes for each spinning unit (11).

3. An improed device to piece-up yarn and doff yarn packages as in claim 1, wherein formation of a reserve of yarn for the piecing-up is carried out by a pivoting mechanical arm (23).

4. An improved device to piece-up yarn and doff yarn packages as in claim 1, wherein an auxiliary yarn package (38) is located on the carriage (12) and supplies yarn (138) for the piecing-up.

5. An improved device to piece-up yarn and doff yarn packages as in claim 4, wherein a tract of yarn (138–26) comprising the flaw due to the piecing-up is eliminated, and said flaw and the tract of yarn (138) of the auxiliary yarn packages (38) employed for the piecing-up are not included in the yarn package (24) being wound.

6. An improved device to piece-up yarn and doff yarn packages as in claim 1, comprising a manifold (139) which is equipped with at least two plugs (39B) for connection to fixed sockets (39) for air or other fluids either under pressure or being aspirated, said fixed sockets (39) being located on the spinning machine (10) and said plugs (39B) being separated from each other by a pitch the same as the distance between two neighbouring spinning units (11), and said fixed sockets (39) being separated from each other by a distance equal to a multiple of the distance between two neighbouring spinning units, said multiple being the same as the number of plugs (39B) comrised on the manifold (139).

* * * * *